US010322447B2

(12) United States Patent
Pillon

(10) Patent No.: US 10,322,447 B2
(45) Date of Patent: Jun. 18, 2019

(54) ANISOTROPICALLY ALIGNED CARBON NANOTUBES IN A CARBON NANOTUBE METAL MATRIX COMPOSITE

(71) Applicants: DRESSER-RAND COMPANY, Olean, NY (US); Nicholas Pillon, Olean, NY (US)

(72) Inventor: Nicholas Pillon, Olean, NY (US)

(73) Assignee: DRESSER-RAND COMPANY, Olean, NY (US)

( * ) Notice: Subject to any disclaimer, the term of this patent is extended or adjusted under 35 U.S.C. 154(b) by 753 days.

(21) Appl. No.: 14/787,801

(22) PCT Filed: May 6, 2014

(86) PCT No.: PCT/US2014/036882

§ 371 (c)(1),
(2) Date: Oct. 29, 2015

(87) PCT Pub. No.: WO2014/182645

PCT Pub. Date: Nov. 13, 2014

(65) Prior Publication Data

US 2016/0074934 A1 Mar. 17, 2016

Related U.S. Application Data

(60) Provisional application No. 61/821,305, filed on May 9, 2013.

(51) Int. Cl.
*C22C 1/10* (2006.01)
*B22D 25/06* (2006.01)
(Continued)

(52) U.S. Cl.
CPC ..... *B22D 27/02* (2013.01); *B22D 25/06* (2013.01); *B22D 27/08* (2013.01); *C22C 1/1036* (2013.01);
(Continued)

(58) Field of Classification Search
CPC ..... C22C 2026/002; C22C 47/08; C22C 2001/1047; C22C 2001/1052;
(Continued)

(56) References Cited

U.S. PATENT DOCUMENTS 7,591,915 B2 * 9/2009 Noguchi ..... B22F 1/0059 148/538
7,712,512 B2 * 5/2010 Suganuma ..... B22D 17/007 164/113
(Continued)

OTHER PUBLICATIONS

Neubauer, E. et al. "Potential and challenges of metal-matrix-composites reinforced with carbon nanofibers and carbon nanotubes." Composites Science and Technology. vol. 70, pp. 2228-2236. doi:10.1016/j.compscitech.2010.09.003 (Year: 2010).*

*Primary Examiner* — Tima M McGuthry-Banks

(57) ABSTRACT

A method is provided for fabricating a carbon nanotube metal matrix composite. The method may include forming a molten mixture by combining carbon nanotubes with a molten solution. The carbon nanotubes combined with the molten solution may be dispersed therein. The method may also include transferring the molten mixture to a mold and applying a magnetic field to the molten mixture in the mold to substantially align at least a portion of the carbon nanotubes with one another. The method may further include solidifying the molten mixture in the mold to fabricate the carbon nanotube metal matrix composite, where at least a portion of the carbon nanotubes may be substantially aligned in the carbon nanotube metal matrix composite.

20 Claims, 3 Drawing Sheets

(51) Int. Cl.

| | |
|---|---|
| ***B22D 27/02*** | (2006.01) |
| ***B22D 27/08*** | (2006.01) |
| ***C22C 47/08*** | (2006.01) |
| ***C22C 26/00*** | (2006.01) |
| *C22C 47/02* | (2006.01) |

(52) U.S. Cl.
CPC ..... *C22C 26/00* (2013.01); *C22C 47/08* (2013.01); *B22F 2998/10* (2013.01); *B22F 2999/00* (2013.01); *C22C 2026/002* (2013.01)

(58) Field of Classification Search
CPC ..... C22C 2001/1057; C22C 1/1036; B22D 27/02; B22D 27/08; B22D 25/06
See application file for complete search history.

(56) References Cited

U.S. PATENT DOCUMENTS

| | | | | |
|---|---|---|---|---|
| 7,803,262 | B2 * | 9/2010 | Haik | B29C 67/24 204/557 |
| 2010/0038595 | A1 * | 2/2010 | Imholt | F42B 15/34 252/478 |
| 2010/0203351 | A1 * | 8/2010 | Nayfeh | C03C 4/12 428/622 |
| 2011/0303866 | A1 * | 12/2011 | Li | B22D 1/00 252/62 |
| 2012/0152480 | A1 * | 6/2012 | Nayfeh | B22D 17/14 164/61 |

* cited by examiner

ANISOTROPICALLY ALIGNED CARBON NANOTUBES IN A CARBON NANOTUBE METAL MATRIX COMPOSITE

CROSS-REFERENCE TO RELATED APPLICATIONS

The present application is a national stage application of PCT Pat. App. No. PCT/US2014/036882, filed May 6, 2014, which claims priority to U.S. Provisional Patent Application having Ser. No. 61/821,305, which was filed May 9, 2013. These priority applications are hereby incorporated by reference in their entirety into the present application, to the extent that they are not inconsistent with the present application.

BACKGROUND

Conventional turbomachines, such as turbines, compressors, and compact motor-compressors, are often utilized in a myriad of applications and industrial processes that expose the turbomachines and/or components thereof to extreme operating conditions (e.g., high temperatures and mechanical stress). Accordingly, the turbomachines and/or components thereof are often fabricated from materials, such as metals and alloys, which provide the required strength and stiffness to endure these extreme operation conditions. For example, conventional turbomachines and/or components thereof are often fabricated from carbon and stainless steels, which provide high tensile strength, ductility, and stiffness.

As advancements are made in these industrial processes, however, production requirements for the turbomachines are often heightened. In many cases, to meet the heightened production requirements, the size or dimensions of the turbomachines and/or components thereof are often increased. Increasing the size of the turbomachines and/or components thereof, however, results in a corresponding increase in mass due to the high density of the metals and alloys, which may be detrimental to efficient operation and production in the turbomachines. Additionally, increasing production may require subjecting the turbomachines and/or components thereof to higher operating temperatures and/or mechanical stresses. Accordingly, the materials used to fabricate the turbomachines and/or components thereof must be capable of enduring the higher operating temperatures and/or mechanical stresses.

In view of the foregoing, attempts have been made to discover or create lightweight materials having properties (e.g., strength and/or stiffness) that meet or exceed those of metals and alloys. These attempts have resulted in the development of composite materials, such as metal matrix composites. Metal matrix composites may include a metal matrix having one or more reinforcing materials dispersed therein. The properties of the metal matrix composites may be tailored by modifying the metal matrix and/or the reinforcing materials. For example, to fabricate a metal matrix composite having a low density and high strength, a low density metal, such as aluminum, may be combined with a high strength reinforcing material, such as carbon fibers. Recently, attempts have been made to utilize carbon nanotubes as the reinforcing material, due to the improved mechanical properties they exhibit over other materials, such as carbon fibers. However, the majority of these attempts have not been successful or have resulted in composite materials with properties that are inadequate for industrial applications. Further, these attempts often provide metal matrix composites where the carbon nanotubes are randomly dispersed therein, thereby providing composite materials with only isotropic properties.

What is needed, then, are methods for fabricating carbon nanotube metal matrix composites having carbon nanotubes aligned or substantially aligned and homogenously dispersed therein, thereby providing the carbon nanotube metal matrix composite with anisotropic properties.

SUMMARY

Embodiments of the disclosure may provide a method for fabricating a carbon nanotube metal matrix composite. The method may include forming a molten mixture by combining carbon nanotubes with a molten solution. The carbon nanotubes combined with the molten solution may be dispersed therein. The method may also include transferring the molten mixture to a mold and applying a magnetic field to the molten mixture in the mold to substantially align at least a portion of the carbon nanotubes with one another. The method may further include solidifying the molten mixture in the mold to fabricate the carbon nanotube metal matrix composite, where at least a portion of the carbon nanotubes may be substantially aligned in the carbon nanotube metal matrix composite.

Embodiments of the disclosure may further provide another method for fabricating a carbon nanotube metal matrix composite. The method may include forming a molten mixture by combining carbon nanotubes with a molten solution, where the carbon nanotubes are dispersed in the molten solution. The method may also include transferring the molten mixture to a mold and rotating the mold to direct the molten mixture to an inner surface of the mold. The rotation of the mold may substantially align at least a portion of the carbon nanotubes dispersed in the molten mixture. The method may further include solidifying the molten mixture in the mold to fabricate the carbon nanotube metal matrix composite, where at least a portion of the carbon nanotubes may be aligned in the carbon nanotube metal matrix composite.

Embodiments of the disclosure may further provide another method for fabricating a carbon nanotube metal matrix composite. The method may include forming a molten mixture by combining carbon nanotubes with a molten solution. The method may also include mixing the molten mixture to disperse the carbon nanotubes in the molten solution and transferring the molten mixture to a mold. The method may further include aligning at least a portion of the carbon nanotubes with one another in the mold. The method may also include solidifying the molten mixture in the mold to fabricate the carbon nanotube metal matrix composite, where at least a portion of the carbon nanotubes in the carbon nanotube metal matrix composite may be substantially aligned therein.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
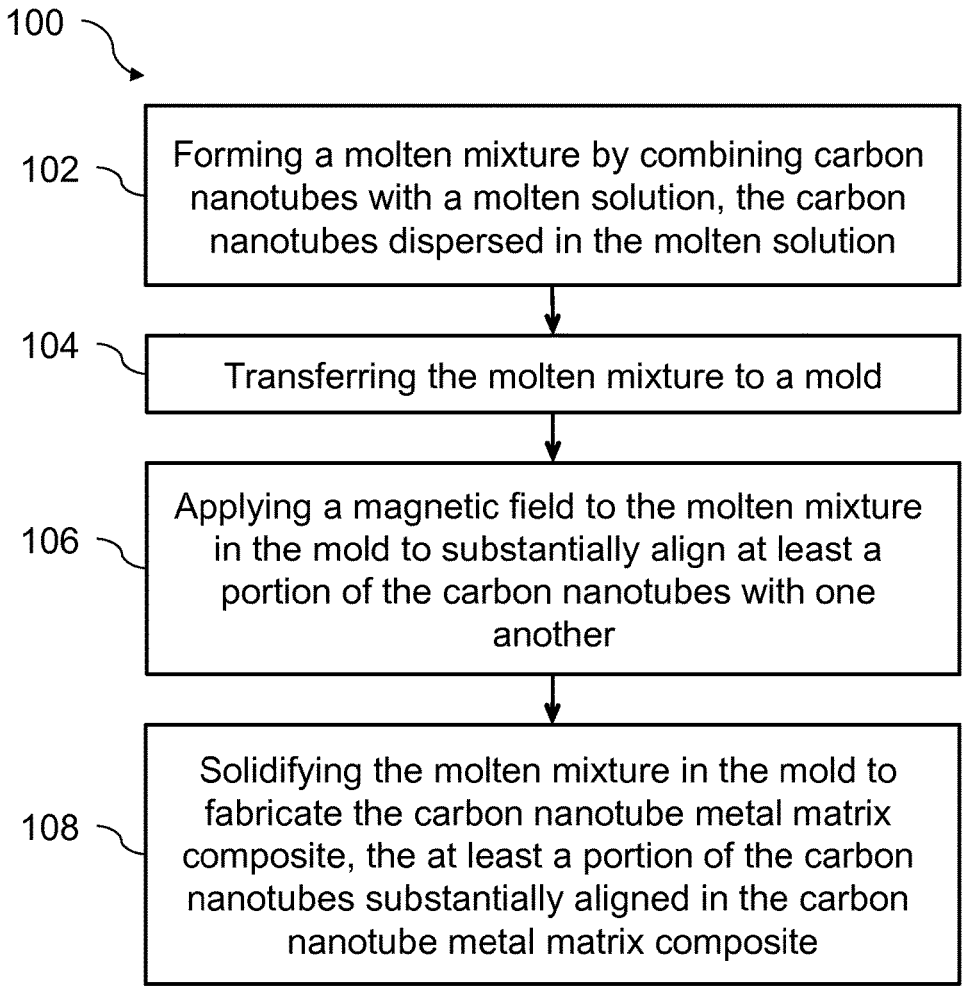
FIG. 1 illustrates a flowchart of a method for fabricating a carbon nanotube metal matrix composite, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Carbon nanotube metal matrix composites may include a metal matrix having carbon nanotubes disposed or dispersed therein. The carbon nanotubes may include carbon-based molecules having a generally elongated, hollow, tubular structure. In at least one embodiment, the hollow, tubular structure of the carbon nanotubes may be formed from two-dimensional sheets of hexagonally arrayed carbon atoms having a thickness of a single carbon atom, referred to as graphene. The two-dimensional sheets of graphene may be rolled along various angles to provide the tubular structures of the carbon nanotubes. The two-dimensional sheets of graphene may also form carbon nanotubes with tubular structures having varying diameters. The angles in which the two-dimensional sheets of graphene are rolled and/or the diameter of the resulting tubular structure may determine one or more properties of the carbon nanotubes. For example, the angle in which the two-dimensional sheets of graphene are rolled may determine a chirality of the carbon nanotubes, which may determine, at least in part, whether the carbon nanotubes exhibit metallic or semiconductive properties.

In at least one embodiment, the hollow, tubular structure of the carbon nanotubes may include straight or bent sidewalls and the ends of the tubular structure may be open and/or closed. The carbon nanotubes may be single-walled nanotubes, double-walled nanotubes, and/or multi-walled nanotubes. The carbon nanotubes may be purified carbon nanotubes and/or crude carbon nanotubes (e.g., as synthesized). The carbon nanotubes may be bare or pristine carbon nanotubes and/or functionalized carbon nanotubes. Pristine carbon nanotubes may include carbon nanotubes that have not undergone any surface modifications and/or treatments subsequent to synthesis and/or purification thereof. Functionalized carbon nanotubes may include carbon nanotubes that may have undergone a surface modification and/or treatment such that one or more functional chemical moiety or moieties are associated therewith. For example, functionalized carbon nanotubes may include carbon nanotubes that have undergone a surface modification treatment such that one or more functional chemical moiety or moieties are associated with the sidewalls (i.e., inner and/or outer sidewalls) and/or the ends of the hollow, tubular structure. In at least one embodiment, the carbon nanotubes may be functionalized with the chemical moiety or moieties to modify one or more properties (e.g., mechanical, thermal, electrical, solubility, etc.) thereof.

In at least one embodiment, the carbon nanotubes may include carbon nanotube composites. The carbon nanotube composites may be or include carbon nanotubes coupled with and/or combined with (e.g., chemically and/or physically) at least one other element or constituent. Illustrative carbon nanotube composites may include, but are not limited to, metal-oxide/carbon nanotube composites, metal/carbon nanotube composites, and the like. In at least one embodiment, the carbon nanotube composites may include carbon nanotubes coupled with and/or combined with one or more magnetic elements or constituents, which may induce and/or enhance the magnetic properties or magnetic susceptibility thereof.

In at least one embodiment, the carbon nanotubes may be aligned or substantially aligned with one another within the metal matrix of the carbon nanotube metal matrix composite. For example, the carbon nanotubes may be dispersed in the metal matrix such that a longitudinal axis of the tubular structure of the carbon nanotubes are aligned or substantially aligned with one another. The alignment or substantial alignment of the carbon nanotubes along the longitudinal axes thereof may provide the carbon nanotube metal matrix composite with one or more anisotropic properties. For example, the carbon nanotubes may have increased mechanical strength along the longitudinal axis of the tubular structure as compared to the mechanical strength normal or perpendicular to the longitudinal axis. Accordingly, the alignment or substantial alignment of the carbon nanotubes along the longitudinal axes thereof may provide carbon nanotube metal matrix composites having increased mechanical strength in the direction in which the longitudinal axis of the carbon nanotubes are aligned as compared to the direction normal to the longitudinal axis of the carbon nanotubes.

In at least one embodiment, the sidewalls and/or the ends of the carbon nanotubes may include one or more structural defects. For example, the sidewalls and/or ends of the carbon nanotubes may include pentagonal and/or heptagonal arrays of carbon atoms, as opposed to hexagonal arrays of carbon atoms. In another example, the carbon nanotubes may also include one or more vacancies in the sidewalls and/or the ends thereof. The structural defects in the carbon nanotubes may modify one or more properties thereof. For example, the structural defects may induce magnetic properties within the carbon nanotubes. In at least one embodiment, the degree or magnitude in which the properties (e.g., magnetic properties) of the carbon nanotubes are modified may be determined, at least in part, by the number or amount of structural defects present, referred to as the defect density. For example, carbon nanotubes with greater structural defect densities may exhibit increased magnetic properties as compared to carbon nanotubes with lower structural defect densities.

The carbon nanotubes may have magnetic properties and/or exhibit magnetic susceptibility. In at least one embodiment, the carbon nanotubes may be induced into a magnetic state. For example, the carbon nanotubes may be subjected to a magnetic field to induce the carbon nanotubes into the magnetic state. In at least one embodiment, the magnetic susceptibility of the carbon nanotubes may be determined, at least in part, by the type of carbon nanotubes utilized. For example, metallic carbon nanotubes may exhibit greater magnetic susceptibility as compared to semiconductive carbon nanotubes. In another example, the carbon nanotubes may be functionalized and/or treated to provide functionalized carbon nanotubes and/or carbon nanotube composites having magnetic properties and/or exhibiting magnetic susceptibility. In at least one embodiment, the magnetic properties and/or magnetic susceptibility of the carbon nanotubes may provide a method for aligning or substantially aligning the carbon nanotubes within the metal matrix of the carbon nanotube metal matrix composite. For example, a magnetic field may be applied to the carbon nanotubes in one or more steps of fabricating the carbon nanotube metal matrix composite to induce alignment or substantial alignment of the carbon nanotubes along the longitudinal axis of the tubular structure.

The carbon nanotube metal matrix composite may be fabricated by contacting or combining the metal matrix with the carbon nanotubes. The metal matrix may be or include any metal and/or alloy. In at least one embodiment, the metal and/or alloy combined with the carbon nanotubes may be provided as a solid (e.g., powdered metal). In another embodiment, the metal and/or alloy combined with the carbon nanotubes may be provided as a liquid, or molten solution. The metal and/or alloy utilized in the metal matrix may be determined, at least in part, by a melting point thereof. For example, subjecting the carbon nanotubes to elevated temperatures may degrade or damage the tubular structure of the carbon nanotubes. As such, the metal matrix may include metals and/or alloys having a melting point at a temperature lower than the temperature sufficient to degrade or damage the carbon nanotubes. In at least one embodiment, the carbon nanotubes may be functionalized and/or treated to prevent degradation and/or damage thereto. Accordingly, functionalized carbon nanotubes and/or carbon nanotube composites may be combined with the molten solution without degrading or damaging the carbon nanotubes.

In at least one embodiment, the metal and/or alloy combined with the carbon nanotubes may be determined, at least in part, by one or more reactions at the interfacing surfaces between the carbon nanotubes and the molten solution. For example, combining the carbon nanotubes with the molten solution may result in the formation of one or more reaction products (e.g., chemical reaction products) at the interfacing surfaces therebetween. The formation of the reaction products may increase or decrease the interaction or bonding between the carbon nanotubes and the metal matrix. Increasing the bonding between the metal matrix and the carbon nanotubes may allow any mechanical stresses or forces applied to the metal matrix to be transferred to the carbon nanotubes, thereby providing carbon nanotube metal matrix composites with increased mechanical strength. The formation of the reaction product at the interfacing surfaces may also increase wetting of the molten solution about the tubular structure of the carbon nanotubes, which may increase the bonding strength between the carbon nanotubes and the metal matrix. In at least one embodiment, the carbon nanotubes may be functionalized and/or treated to provide functionalized carbon nanotubes and/or carbon nanotube composites that may increase the formation of the reaction products at the interfacing surfaces, thereby increasing the wetting of the molten solution about the tubular structure of the carbon nanotubes.

To fabricate the carbon nanotube metal matrix composites, the carbon nanotubes may be combined with the molten solution via one or more high temperature metal processing operations. Illustrative high temperature metal processing operations may include, but are not limited to, a foundry process, and the carbon nanotubes may be combined with the molten solution during one or more steps of the foundry process. For example, the carbon nanotubes may be combined with the molten solution in the casting and/or forging steps of the foundry process. In at least one embodiment, the carbon nanotubes may be combined with the molten solution in one or more melting furnaces, ladles, metal treatment boxes, or any combination thereof. Illustrative furnaces may include, but are not limited to, electric induction furnaces, cupolas, electric arc furnaces, rotary furnaces, gas-fired furnaces, such as gas-fired shaft and resistance furnaces, gas and oil-fired crucible furnaces, or any combination thereof. Illustrative ladles may include, but are not limited to, one or more treatment ladles, transfer ladles, pouring ladles, pouring boxes, or any combination thereof. As previously discussed, a magnetic field may be applied to the carbon nanotubes to induce the carbon nanotubes into a magnetic state. The magnetic field may be applied to the carbon nanotubes before, during, and/or after combining the carbon nanotubes with the molten solution.

In at least one embodiment, contacting or combining the molten solution with the carbon nanotubes may result in a turbulent reaction that may disperse the carbon nanotubes within the molten solution, thereby increasing the distribution or homogeneity of the carbon nanotubes within the molten mixture. In another embodiment, the carbon nanotubes may be combined with the molten solution, and the resulting molten mixture may be subjected to one or more mechanical processes to increase the distribution or homogeneity of the carbon nanotubes within the molten mixture.

The molten mixture may be transferred to a mold and subsequently cooled or solidified therein to provide the carbon nanotube metal matrix composite. A magnetic field may be applied to the molten mixture contained in the mold to align the carbon nanotubes dispersed therein. In at least one embodiment, the magnetic field may be provided by one or more magnets, such as electromagnets, positioned in and/or about the mold at one or more predetermined locations. The electromagnets may be positioned or located in and/or about the mold such that the carbon nanotubes may align or substantially align with one another along their longitudinal axes. For example, the magnets may be positioned such that the magnetic field may be applied to a distance or portion of the mold and/or the mold cavity and the molten mixture may be flowed through the portion of the mold and/or the mold cavity to align the carbon nanotubes. In another example, the magnets may be positioned such that the magnetic field may be applied to the entire mold and/or the mold cavity. Subsequent cooling or solidification of the molten mixture in the mold may provide the carbon nanotube metal matrix composite having aligned or substantially aligned carbon nanotubes dispersed therein.

In at least one embodiment, a centrifugal casting process may be utilized to fabricate the carbon nanotube metal matrix composites. For example, the molten mixture may be transferred to a rotating mold and subsequently cooled or solidified therein to provide the carbon nanotube metal matrix composites. Centrifugal forces resulting from the rotation of the mold may direct the molten mixture toward an inner surface of the mold. In at least one embodiment, the rotation of the mold may result in a directional flow of the molten mixture along the inner surface thereof. For example, the molten mixture may flow in the direction in which the mold is rotated. In at least one embodiment, the flow of the molten mixture may align and/or substantially align the carbon nanotubes with one another. For example, the flow of the molten mixture may cause the carbon nanotubes to migrate or rotate such that the longitudinal axes thereof are aligned with the directional flow of the molten mixture. Accordingly, the subsequent cooling or solidification of the molten solution in the rotating mold may provide carbon nanotube metal matrix composites having aligned or substantially aligned carbon nanotubes dispersed therein. In at least one embodiment, the centrifugal forces may also cause the carbon nanotubes to migrate in a direction radial to the direction of rotation of the mold. The migration of the carbon nanotubes may provide a method of concentrating the carbon nanotubes at a predetermined portion of the resulting carbon nanotube metal matrix composite. For example, the molten mixture may be rotated such that carbon nanotubes are concentrated about an inner or outer portion of the resulting carbon nanotube metal matrix composite.

The carbon nanotube metal matrix composites described herein may be used in the fabrication of any system, device, apparatus, assembly, or components thereof, that may utilize metals and/or alloys. For example, the carbon nanotube metal matrix composites may be used in the fabrication of one or more turbomachines and/or components thereof. Illustrative turbomachines may include, but are not limited to, turbines, compressors, pumps, and the like. Illustrative components that may be fabricated from the carbon nanotube metal matrix composites may include, but are not limited to, inlet guide vanes, exit guide vanes, buckets, exhausts, shrouds, housings or casings, seal rings, blades, discs, rotor wheels, nozzles, diffusers, stages, rotary shafts, diaphragms, rods, sleeves, pistons, support assemblies, bearing assemblies, or the like.

FIG. 1 illustrates a flowchart of a method 100 for fabricating a carbon nanotube metal matrix composite, according to one or more embodiments. The method 100 may include forming a molten mixture by combining carbon nanotubes with a molten solution, the carbon nanotubes dispersed in the molten solution, as shown at 102. The method 100 may also include transferring the molten mixture to a mold, as shown at 104. The method 100 may further include applying a magnetic field to the molten mixture in the mold to substantially align at least a portion of the carbon nanotubes with one another, as shown at 106. The method 100 may also include solidifying the molten mixture in the mold to fabricate the carbon nanotube metal matrix composite, the at least a portion of the carbon nanotubes substantially aligned in the carbon nanotube metal matrix composite, as shown at 108.

Figure 2:
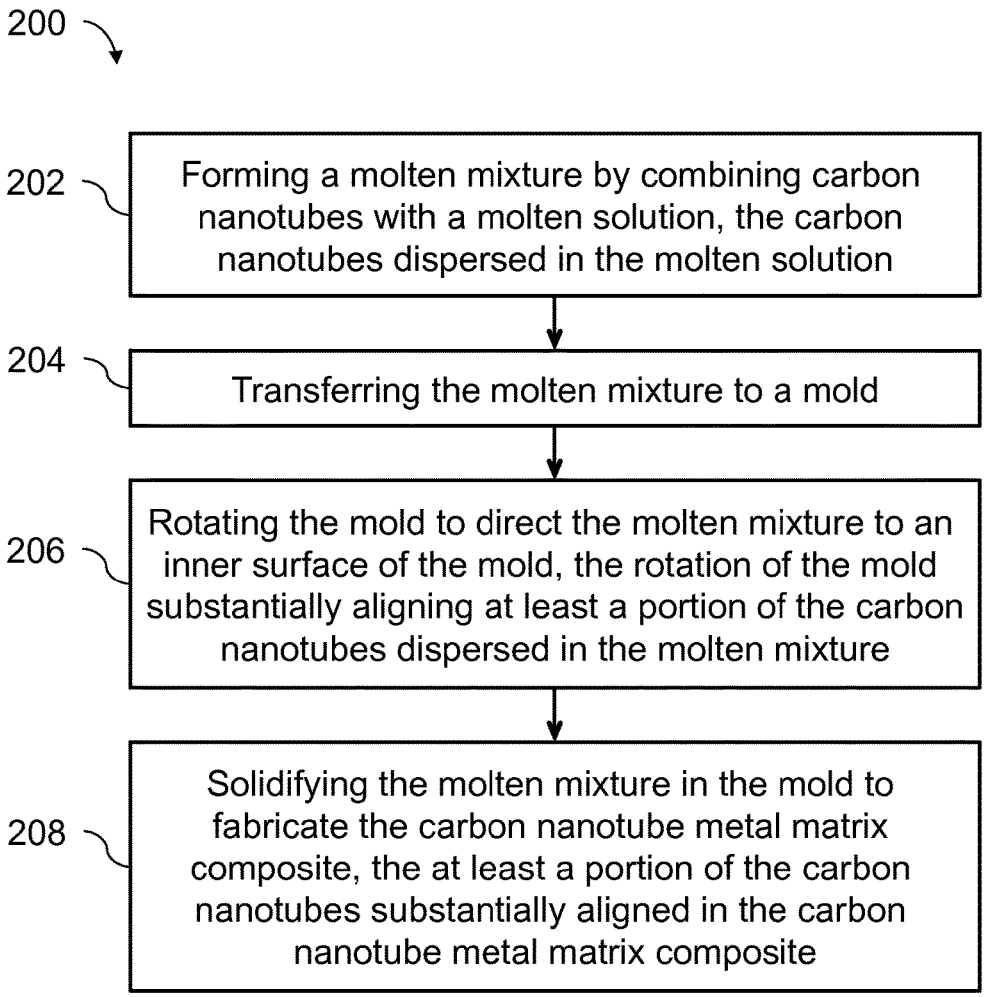
FIG. 2 illustrates a flowchart of another method for fabricating a carbon nanotube metal matrix composite, according to one or more embodiments disclosed.

FIG. 2 illustrates a flowchart of another method 200 for fabricating a carbon nanotube metal matrix composite, according to one or more embodiments. The method 200 may include forming a molten mixture by combining carbon nanotubes with a molten solution, the carbon nanotubes dispersed in the molten solution, as shown at 202. The method 200 may also include transferring the molten mixture to a mold, as shown at 204. The method 200 may further include rotating the mold to direct the molten mixture to an inner surface of the mold, the rotation of the mold substantially aligning at least a portion of the carbon nanotubes dispersed in the molten mixture, as shown at 206. The method 200 may also include solidifying the molten mixture in the mold to fabricate the carbon nanotube metal matrix composite, the at least a portion of the carbon nanotubes substantially aligned in the carbon nanotube metal matrix composite, as shown at 208.

Figure 3:
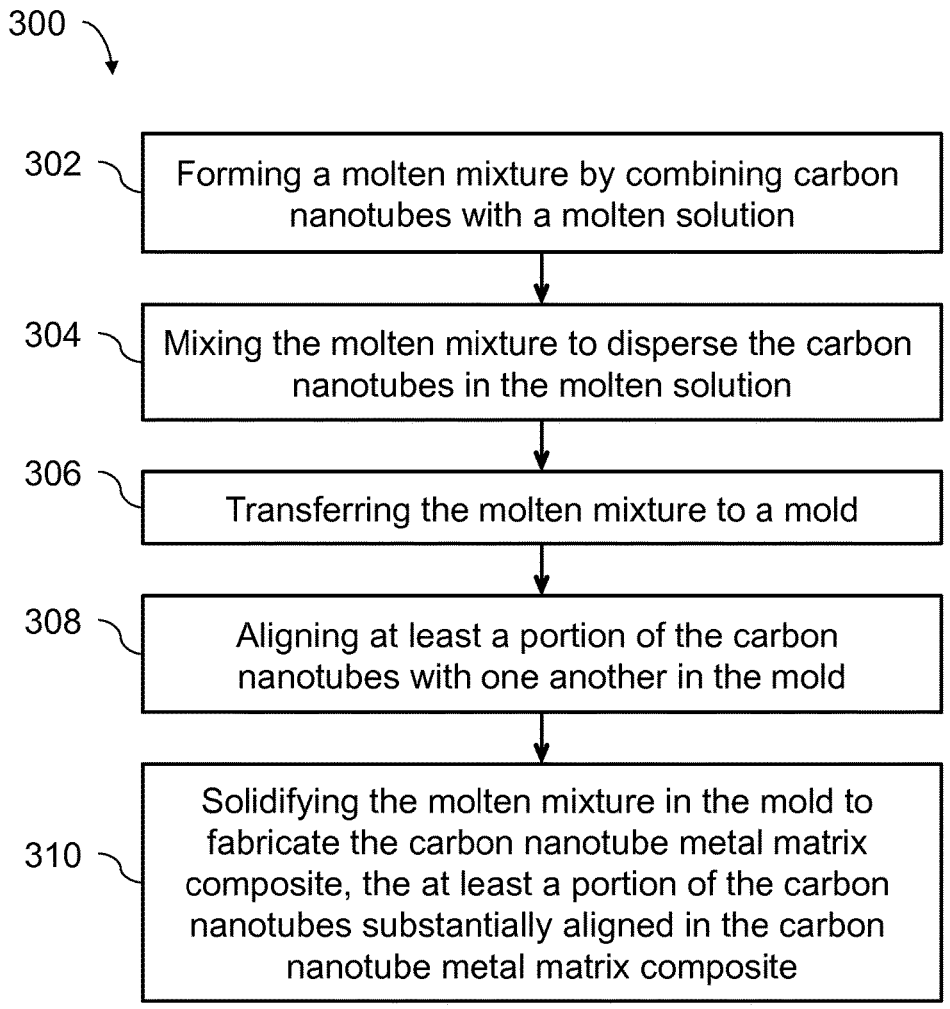
FIG. 3 illustrates a flowchart of another method for fabricating a carbon nanotube metal matrix composite, according to one or more embodiments disclosed.

FIG. 3 illustrates a flowchart of another method 300 for fabricating a carbon nanotube metal matrix composite, according to one or more embodiments. The method 300 may include forming a molten mixture by combining carbon nanotubes with a molten solution, as shown at 302. The method 300 may also include mixing the molten mixture to disperse the carbon nanotubes in the molten solution, as shown at 304. The method 300 may further include transferring the molten mixture to a mold, as shown at 306. The method 300 may also include aligning at least a portion of the carbon nanotubes with one another in the mold, as shown at 308. The method 300 may also include solidifying the molten mixture in the mold to fabricate the carbon nanotube metal matrix composite, the at least a portion of the carbon nanotubes substantially aligned in the carbon nanotube metal matrix composite, as shown at 310.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A method for fabricating a carbon nanotube metal matrix composite, comprising:

treating carbon nanotubes to have a desired magnetic susceptibility;

forming a molten mixture by combining the carbon nanotubes with a molten solution, the carbon nanotubes dispersed in the molten solution;

transferring the molten mixture to a mold;

applying a magnetic field to the molten mixture in the mold to substantially align respective longitudinal axes of at least a portion of the carbon nanotubes with one another; and solidifying the molten mixture in the mold to fabricate the carbon nanotube metal matrix composite, the at least a portion of the carbon nanotubes with the respective longitudinal axes substantially aligned with one another configured to impart an anisotropic property to the carbon nanotube metal matrix composite along the respective longitudinal axes of the carbon nanotubes.

2. The method of claim 1, further comprising positioning an electromagnet about the mold, the electromagnets configured to apply the magnetic field to the molten mixture.

3. The method of claim 1, further comprising positioning an electromagnet within the mold, the electromagnets configured to apply the magnetic field to the molten mixture.

4. The method of claim 1, further comprising functionalizing the carbon nanotubes such that one or more chemical moieties are associated therewith.

5. The method of claim 1, further comprising forming a reaction product at an interfacing surface between at least one of the carbon nanotubes and the molten solution.

6. The method of claim 5, wherein the reaction product formed at the interfacing surface between the at least one of the carbon nanotubes and the molten solution increases wetting of the molten solution about the at least one of the carbon nanotubes.

7. The method of claim 5, wherein the reaction product formed at the interfacing surface between the at least one of the carbon nanotubes and the molten solution increases bonding between the molten solution and the at least one of the carbon nanotubes.

8. A method for fabricating a carbon nanotube metal matrix composite, comprising:

forming a molten mixture by combining carbon nanotubes with a molten solution, the carbon nanotubes dispersed in the molten solution;

transferring the molten mixture to a mold;

rotating the mold to cause a directional flow of the molten mixture along an inner surface of the mold, the directional flow of the molten mixture substantially aligning respective longitudinal axes of at least a portion of the carbon nanotubes dispersed in the molten mixture; and solidifying the molten mixture in the mold to fabricate the carbon nanotube metal matrix composite, the at least a portion of the carbon nanotubes with the respective longitudinal axes substantially aligned with one another configured to impart an anisotropic property to the carbon nanotube metal matrix composite along the respective longitudinal axes of the carbon nanotubes.

9. The method of claim 8, wherein the rotation of the mold results in a flow of the molten mixture along the inner surface of the mold, the flow of the molten mixture substantially aligning the at least a portion of the carbon nanotubes dispersed in the molten mixture.

10. The method of claim 8, wherein the mold is rotated about a rotational axis, the rotation of the mold causing migration of the carbon nanotubes in the molten mixture in a direction radial to the rotational axis.

11. The method of claim 8, further comprising forming a reaction product at an interfacing surface between at least one of the carbon nanotubes and the molten solution.

12. The method of claim 11, wherein the reaction product formed at the interfacing surface between the at least one of the carbon nanotubes and the molten solution increases wetting of the molten solution about the at least one of the carbon nanotubes.

13. The method of claim 11, wherein the reaction product formed at the interfacing surface between the at least one of the carbon nanotubes and the molten solution increases bonding between the molten solution and the at least one of the carbon nanotubes.

14. A method for fabricating a carbon nanotube metal matrix composite, comprising:

forming a molten mixture by combining carbon nanotubes with a molten solution;

mixing the molten mixture to disperse the carbon nanotubes in the molten solution;

transferring the molten mixture to a mold;

aligning in the mold respective longitudinal axes of at least a portion of the carbon nanotubes with one another, the aligning in response to a magnetic field applied to the mold, or in response to a directional flow of the molten mixture along an inner surface of the mold, the directional flow of the molten mixture resulting from rotation of the mold; and solidifying the molten mixture in the mold to fabricate the carbon nanotube metal matrix composite, the at least a portion of the carbon nanotubes with the respective longitudinal axes substantially aligned with one another configured to impart an anisotropic property to the carbon nanotube metal matrix composite along the respective longitudinal axes of the carbon nanotubes.

15. The method of claim 14, further comprising inducing the carbon nanotubes into a magnetic state before combining the carbon nanotubes with the molten solution.

16. The method of claim 14, wherein aligning the at least a portion of the carbon nanotubes with one another in the mold comprises applying a magnetic field to the molten mixture in the mold.

17. The method of claim 14, wherein aligning the at least a portion of the carbon nanotubes with one another in the mold comprises rotating the mold to direct the molten mixture to an inner surface of the mold, the rotation of the mold substantially aligning the at least a portion of the carbon nanotubes dispersed in the molten mixture.

18. The method of claim 14, further comprising forming a reaction product at an interfacing surface between at least one of the carbon nanotubes and the molten solution.

19. The method of claim 14, wherein a reaction product formed at the interfacing surface between the at least one of the carbon nanotubes and the molten solution increases wetting of the molten solution about the at least one of the carbon nanotubes.

20. The method of claim 14, wherein a reaction product formed at the interfacing surface between the at least one of the carbon nanotubes and the molten solution increases bonding between the molten solution and the at least one of the carbon nanotubes.

* * * * *